United States Patent [19]

Silberstein

[11] Patent Number: 4,585,015

[45] Date of Patent: Apr. 29, 1986

[54] CIGARETTE FILTER

[75] Inventor: Donald A. Silberstein, LeMans, France

[73] Assignee: Brown & Williamson Tobacco Corporation, Louisville, Ky.

[21] Appl. No.: 672,053

[22] Filed: Nov. 16, 1984

[51] Int. Cl.[4] ..... A24D 3/04

[52] U.S. Cl. ..... 131/339; 131/338; 131/361

[58] Field of Search ..... 131/336, 339, 338, 340, 131/361

[56] References Cited

U.S. PATENT DOCUMENTS 3,389,705 6/1968 Levavi ..... 131/339
3,777,765 12/1973 Yoshinaga ..... 131/339
3,860,011 1/1975 Norman ..... 131/336

*Primary Examiner*—V. Millin
*Attorney, Agent, or Firm*—Charles G. Lamb

[57] ABSTRACT

A filter for a cigarette has a porous filter rod with a channel extending longitudinally through the filter rod. The end of the filter at the tobacco column of the cigarette includes a partition having an orifice therethrough of a smaller cross-sectional area than the cross-sectional area of the channel to provide flow communication between the tobacco column and the channel. The partition further provides for the flow of smoke from the tobacco column into the filter wherein the smoke is diluted as it is being filtered by ventilation air entering the filter rod through an air permeable material circumscribing the filter rod.

2 Claims, 4 Drawing Figures

CIGARETTE FILTER

BACKGROUND OF THE INVENTION

The present invention relates to filters for cigarettes. In one aspect it relates to a cigarette filter providing at least one flow path for cigarette smoke and another flow path for ambient ventilating air and filtered smoke to the mouth end of the filter. In another aspect the present invention relates to a cigarette filter with a flow restriction in the at least one smoke flow path to create a pressure drop to increase the draw resistance therethrough.

DESCRIPTION OF THE PRIOR ART

It is well known in the art of filter cigarettes to provide filters with ventilating air means to dilute the smoke stream. The dilution of the smoke stream reduces the quantity of smoke particulates as well as gas phase components delivered to the mouth of the smoker. A number of means have been proposed and are utilized for introducing ventilating air into the cigarette. For example, the wrapper for the tobacco in a cigarette can be made of a porous material which allows for the introduction of air along the entire length of the cigarette where it mixes with the smoke stream passing therethrough, thereby diluting the smoke in the stream prior to entering the smoker's mouth. In another example, the cigarette wrapper may be perforated at selected locations along the length of the cigarette which provides ports through which ventilating air enters the cigarette to mix with the smoke stream. It is also known to wrap the cigarette filter with a porous filter wrap to allow ventilating air to enter the filter to dilute the smoke stream flowing through the cigarette filter before entering the smoker's mouth. Alternatively, the cigarette filter wrap can be perforated to allow ventilating air to enter the filter to dilute the smoke flowing through the filter. Furthermore, in the introduction of ventilating air into the filter to dilute the smoke therein, circular discs with small orifices have been utilized at the junction of the filter and the tobacco column to accelerate the smoke leaving the tobacco column, examples being noted in U.S. Pat. No. 2,954,778 and U.S. Pat. No. 3,395,713.

SUMMARY OF THE INVENTION

The present invention advantageously provides a straightforward arrangement of a filter for a cigarette which in one aspect provides a pressure drop approaching that of more conventional cigarettes. In a further aspect, the present invention provides a cigarette filter for lowering tar by mixing tobacco smoke with ambient ventilation air and by filtration.

More particularly, the present invention provides a filter for a cigarette comprising a porous filter rod of cylindrical configuration; channel means extending longitudinally through the filter rod from one end to the other end thereof, the channel means having an impervious side wall defining a flow path for tobacco smoke; smoke pervious means disposed at the end of the filter rod which is to interface with a tobacco column of the cigarette; and means defining an orifice through the smoke pervious means for providing communication between the tobacco column of the cigarette and the channel means in the filter rod and creating a pressure drop thereacross.

The above-discussed features and other features of the present invention will become obvious to those skilled in the art upon reading the disclosure set fort hereinafter.

BRIEF DESCRIPTION OF THE DRAWINGS

A better understanding of the present invention will be had upon reading the following specification and by reference to the accompanying drawings, in which like numerals refer to like parts throughout the several figures and wherein.

DESCRIPTION OF THE PREFERRED EMBODIMENT

Figure 1:
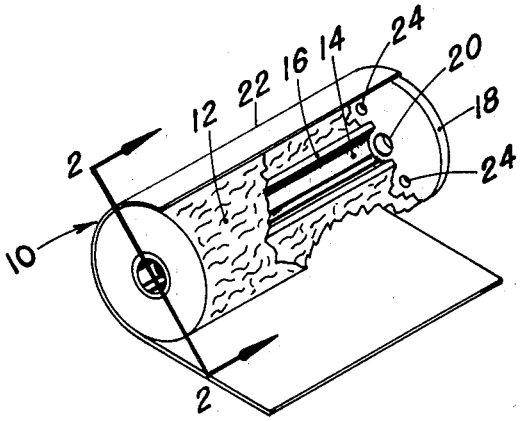
FIG. 1 is a perspective view, partially cross-sectioned, of a cigarette filter embodying various features of the present invention.
Figure 2:
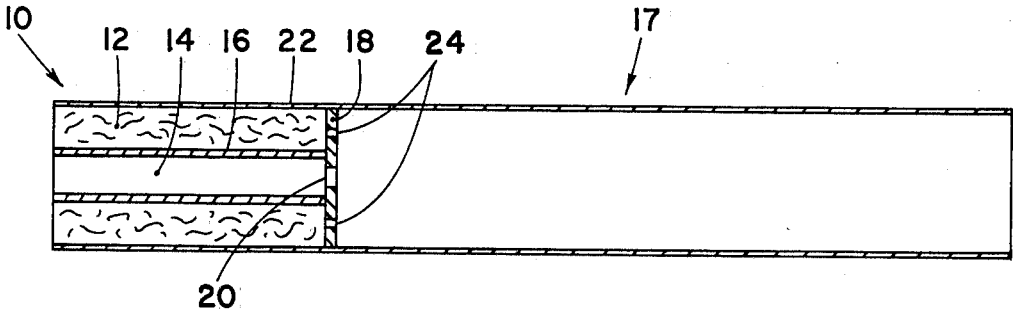
FIG. 2 is a longitudinal cross-sectioned view of a cigarette having the filter of FIG. 1.

With reference to FIGS. 1 and 2, there is illustrated a cigarette filter 10 of the present invention. The cigarette filter comprises a porous filter rod 12 having a cylindrical configuration. The filter rod is fabricated of fibrous or foamed material such as, for example, cellulose acetate. A chamber or channel 14 extends longitudinally through the filter rod 12 from one end to the other end thereof. The channel 14 is shown as being defined by a hollow tube 16 coaxially disposed within the filter rod 12. The tube 16 is fabricated of smoke and air impermeable material and has a smaller cross-sectional area than the tobacco column 17 with which it is to be used. The end of the filter rod 12 to be disposed at the tobacco column 17 is impervious to smoke. As shown, this is accomplished by transversely disposing a gas impervious partition 18 at the end of the filter rod 12 which is to interface with the tobacco column. The gas impervious partition is formed with at least one first orifice 20 therethrough to provide smoke flow communication between the tobacco column 17 of the cigarette and the channel 14 in the filter rod. As illustrated, the at least one first orifice 20 is shown as being coaxial with the hollow tube 16, but is smaller in cross-sectional area than the transverse cross-sectional area of the tube 16 defining the chamber or channel 14. The cigarette filter rod 12 can be circumscribed with an air pervious tipping material 22. The tipping material can be, for example, fabricated of a porous material or can be perforated at selected positions to provide for the flow of air therethrough into the body of the filter rod 12. The partition 18 is shown as also being formed with at least one second orifice 24 therethrough to provide smoke flow communication between the tobacco column 17 and the filter rod 12. For the sake of illustration, two such second orifices 24 are shown, however, any number of second orifices 24 can be formed through the partition 18 depending upon such design criteria as draw effort and volume rate of flow of smoke into the filter rod 12. Further, as shown, each second orifice 24 has a smaller diameter than the diameter of the first orifice 20.

In the use of the filter 10 of the present invention as shown in FIGS. 1 and 2, tobacco smoke from the tobacco column 17 passes through the orifice 20 and travels through the flow path defined by the channel 14 and out of the channel 14 through its open end at the opposite end of the filter rod 12 from the tobacco column 17. At the same time, tobacco smoke from the tobacco column 17 passes through the second orifice 24 into the filter rod 12. Ambient ventilating air is also drawn into the filter rod 12 through the pervious tipping material 22 wherein it comingles with the smoke and moves, in a separate flow path from that flow path of the unfiltered, undiluted smoke traveling in the channel 14, longitudinally of the filter rod 12 in the interstice of the filter rod to the mouth end of the filter. The comingled smoke and air flowing out of the filter rod 12 and unfiltered, undiluted tobacco smoke flowing out of the channel 14 comingle outside the mouth end of the filter 10 whereupon the tobacco smoke from the channel is diluted with the diluted, filtered smoke from the filter rod 12 while maintaining the flavor of the tobacco smoke.

The orifice 20 is appropriately sized with respect to the transverse cross-sectional area of the channel 14 to provide any desired pressure drop there-across from the tobacco column 17 to the channel 14. The orifice 20 can be advantageously sized to provide a pressure drop to create a draw effort of a more conventional cigarette. Furthermore, when the first orifice 20 is appropriately sized to provide, what is called in the industry, a programmed flow effect as the cigarette is smoked, particulate material in the tobacco smoke will accumulate on the wall of the orifice 20 gradually diminishing the size of the orifice with the advantageous result that the draw effort or resistance will gradually increase and, thus, gradually increase the amount of ambient ventilating air being drawn through the filter rod 12. Therefore, the particulate matter delivery is more constant per puff during the smoking process as compared to more conventional filter cigarettes.

Similarly, the second orifices 24 are appropriately sized to provide any desired pressure drop there-across from the tobacco column 17 into the filter rod 12. Furthermore, the second orifices 24 are appropriately sized to provide a programmed smoke flow effect as the cigarette is smoked.

Figure 3:
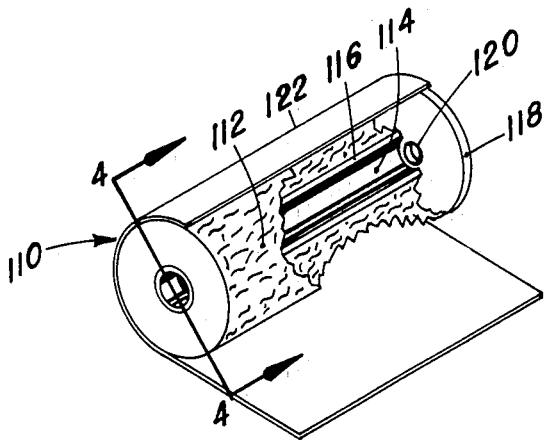
FIG. 3 is a perspective view, partially cross-sectioned, of another advantageous embodiment of a cigarette filter embodying various features of the present invention; and, FIG. 4 is a longitudinal cross-sectioned view of a cigarette having the filter of FIG. 3.
Figure 4:
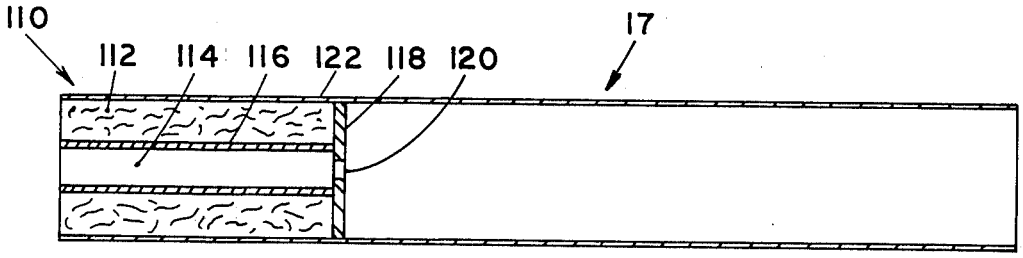

With reference to FIGS. 3 and 4, there is illustrated another advantageous embodiment of a cigarette filter 110 of the present invention. The cigarette filter comprises a porous filter rod 112 having a cylindrical configuration. The filter rod is fabricated of fibrous or foamed material such as, for example, cellulose acetate. A chamber or channel 114 extends longitudinally through the filter rod 112 from one end to the other end thereof. The channel 114 is shown as being defined by a hollow tube 116 coaxially disposed within the filter rod 112. The tube 116 is fabricated of smoke and air impermeable material and has a smaller cross-sectional area that the tobacco column with which it is to be used. The end of the filter rod 112 to be disposed at the tobacco column 17 is pervious to smoke. As shown, this is accomplished by transversely disposing a gas pervious partition 118 at the end of the filter rod 112 which is to interface with the tobacco column. The gas pervious partition is formed with at least one orifice 120 to provide smoke flow communication between the tobacco column of the cigarette and the channel 114 in the filter rod. As illustrated, the at least one first orifice 120 is shown as being coaxial with the hollow tube 116, but is smaller in cross-sectional area than the transverse cross-sectional area of the tube 116 defining the chamber or channel 114. The cigarette filter rod 112 can be circumscribed with an air pervious tipping material 122. The tipping material can be, for example, fabricated of a porous material or can be perforated at selected positions to provide for the flow of air therethrough into the body of the filter rod 112.

In the use of the filter 110 of the present invention as shown in FIGS. 3 and 4, tobacco smoke from the tobacco column 17 passes through the orifice 120 and travels through the flow path defined by the channel 114 and out of the channel 114 through its open end at the opposite end of the filter rod 112 from the tobacco column 17. At the same time, tobacco smoke from the tobacco column 17 passes through the pervious partition 118 into the filter rod 112. Ambient ventilating air is also drawn into the filter rod 112 through the pervious tipping material 122 wherein it comingles with the smoke and moves, in a separate flow path from that flow path of the unfiltered, undiluted smoke traveling in the channel 114, longitudinally of the filter rod 112 in the interstice of the filter rod to the mouth end of filter 110. The comingled smoke and air flowing out of the filter rod 112 and unfiltered, undiluted tobacco smoke flowing out of the channel 114 comingle outside the mouth end of the filter 110 whereupon the tobacco smoke from the channel is diluted with the diluted, filtered smoke from the filter rod 112 while maintaining the flavor of the tobacco smoke.

The orifice 120 is appropriately sized with respect to the transverse cross-sectional area of the channel 114 to provide any desired pressure drop there-across from the tobacco column 17 to the channel 114. The orifice can be advantageously sized to provide a pressure drop to create a draw effort of a more conventional cigarette. Furthermore, when the orifice is appropriately sized as the cigarette is smoked, particulate material in the tobacco smoke will accumulate on the wall of the orifice 120 gradually diminishing the size of the orifice with the advantageous result that the draw effort or resistance will gradually increase and, thus, gradually increase the amount of ambient ventilating air being drawn through the filter rod 112. Therefore, the particulate matter delivery is more constant per puff during the smoking process as compared to more conventional filter cigarettes.

It should be kept in mind that the various advantageous results can be altered to suit particular requirements by using different filter rod materials, filter tip wrapping material and changing the relative sizes of the orifice and hollow tube.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A filter for a cigarette comprising: a porous filter rod of cylindrical configuration;

a hollow tube fabricated of impervious material extending longitudinally through said filter rod from one end to the other end thereof defining a flow path for tobacco smoke therethrough;

a partition fabricated of smoke pervious material disposed at the end of said filter rod which interfaces with a tobacco column of the cigarette; and, means defining an orifice through said smoke pervious partition coaxially disposed with the hollow tube and having a smaller cross-sectional area than the transverse cross-sectional area of the hollow tube for providing smoke flow communication between the tobacco column of the cigarette and said hollow tube in said filter rod and creating a pressure drop across said orifice; and, air pervious tipping paper circumscribing said cylindrical filter rod.

2. A filter for a cigarette comprising:

a porous filter rod of cylindrical configuration;

a hollow tube fabricated of impervious material extending longitudinally through said filter rod from one end to the other end thereof defining a flow path for tobacco smoke;

a partition fabricated of smoke impervious material disposed at the end of said filter rod which interfaces with a tobacco column of the cigarette;

means defining an orifice through said smoke impervious partition coaxially disposed with the hollow tube and having a smaller cross-sectional area than the transverse cross-sectional area of the hollow tube for providing smoke flow communication between the tobacco column of the cigarette and said hollow tube in said filter rod and creating a pressure drop across said orifice; and, means defining at least one orifice through the impervious partition for providing smoke flow communication between the porous filter rod and the tobacco column of the cigarette.

* * * * *